US008234797B2

(12) United States Patent
Jergens et al.

(10) Patent No.: US 8,234,797 B2
(45) Date of Patent: Aug. 7, 2012

(54) DRYER DRUM VANE AND VANE SET

(75) Inventors: John M. Jergens, Webster City, IA (US); Michael P. Ricklefs, Webster City, IA (US); Brian D. Ripley, Webster City, IA (US)

(73) Assignee: Electrolux Home Products, Inc., Charlotte, NC (US)

( * ) Notice: Subject to any disclaimer, the term of this patent is extended or adjusted under 35 U.S.C. 154(b) by 855 days.

(21) Appl. No.: 12/251,101

(22) Filed: Oct. 14, 2008

(65) Prior Publication Data

US 2009/0320321 A1 Dec. 31, 2009

Related U.S. Application Data

(60) Provisional application No. 61/077,038, filed on Jun. 30, 2008.

(51) Int. Cl.
*F26B 11/02* (2006.01)

(52) U.S. Cl. ..... 34/499; 34/599; D32/25

(58) Field of Classification Search ..... 34/499, 34/599; D32/25, 26; 432/118
See application file for complete search history.

(56) References Cited

U.S. PATENT DOCUMENTS

| | | | |
|---|---|---|---|
| 2,296,257 | A | 9/1942 | Breckenridge |
| 2,330,420 | A | 9/1943 | Haberstump |
| 2,391,634 | A | 12/1945 | Lewis et al. |
| 2,573,103 | A | 10/1951 | Kling |
| 2,611,976 | A | 9/1952 | Reiter et al. |
| 2,827,276 | A | 3/1958 | Racheter |
| 3,017,758 | A | 1/1962 | Haverstock et al. |
| 3,094,860 | A | 6/1963 | Ferrah |
| 3,364,588 | A | 1/1968 | Ziegler |
| 3,416,334 | A | 12/1968 | Candor et al. |
| 3,514,867 | A | 6/1970 | Patrick |
| 3,605,281 | A | 9/1971 | Hubbard et al. |
| 3,729,834 | A | 5/1973 | Fox |
| 3,765,102 | A | 10/1973 | Fischer |
| 3,792,600 | A | 2/1974 | Hendriksson |
| 3,938,260 | A | 2/1976 | Brenner et al. |
| 4,628,617 | A | 12/1986 | St. Louis |
| 4,835,993 | A | 6/1989 | Dreher |
| 5,371,956 | A | 12/1994 | St. Louis |
| 5,416,983 | A | 5/1995 | Moser |
| D382,684 | S | 8/1997 | Jackovin |
| 5,940,986 | A | 8/1999 | Jelinek et al. |

(Continued)

FOREIGN PATENT DOCUMENTS

| | | |
|---|---|---|
| JP | 59080292 | 5/1984 |

(Continued)

*Primary Examiner* — Mark A Osele
(74) *Attorney, Agent, or Firm* — Banner & Witcoff, Ltd

(57) ABSTRACT

A mixing laundry dryer vane has a general profile which is scooped or "saddle" shaped. The mixing dryer vane has two relatively tall end portions and a reduced height central portion. The mixing dryer vane may have an upper surface that extends arcuately from one taller end portion to the other taller end portion. The arcuate shape may define along the length of the vane a relatively deep concavity which defines the reduced height central portion. The mixing dryer vane's taller end portions may be configured and positioned to cause "wiping" of clothes off and away from an exhaust duct grill within the dryer. The taller end portions of the vane may have a generally propeller-like twist that directs clothes towards the scooped central portion of the vane. The scooped mixing vane in combination with other non-scooped dryer vanes can reduce or eliminate the tendency of harmonic tumbling of a load.

15 Claims, 5 Drawing Sheets

U.S. PATENT DOCUMENTS

| | | | |
|---|---|---|---|
| 6,324,771 | B1 | 12/2001 | McAllister et al. |
| 6,386,004 | B2 | 5/2002 | Salein |
| 6,401,362 | B1 | 6/2002 | Schultz et al. |
| 6,463,767 | B2 | 10/2002 | Uzkureit et al. |
| 6,698,107 | B2 | 3/2004 | Song et al. |
| D502,298 | S | 2/2005 | No et al. |
| 6,868,573 | B2 | 3/2005 | Rohl et al. |
| 6,941,678 | B2 | 9/2005 | Park |
| 6,968,632 | B2 | 11/2005 | Guinibert et al. |
| D513,100 | S | 12/2005 | Shin et al. |
| 7,065,904 | B2 | 6/2006 | Lee et al. |
| 7,065,905 | B2 | 6/2006 | Guinibert et al. |
| 7,117,613 | B2 | 10/2006 | Guinibert et al. |
| 7,178,368 | B2 | 2/2007 | Durazzani |
| 7,194,824 | B2 | 3/2007 | Wang |
| 7,225,562 | B2 | 6/2007 | Guinibert et al. |
| 7,249,742 | B2 | 7/2007 | Guinibert et al. |
| 7,257,905 | B2 | 8/2007 | Guinibert et al. |
| 2006/0247145 | A1 | 11/2006 | Guinibert et al. |
| 2007/0006477 | A1 | 1/2007 | Guinibert et al. |
| 2007/0186440 | A1 | 8/2007 | Guinibert et al. |
| 2007/0199207 | A1 | 8/2007 | Oh et al. |
| 2007/0220776 | A1 | 9/2007 | Guinibert et al. |

FOREIGN PATENT DOCUMENTS

| | | |
|---|---|---|
| JP | 401285299 | 11/1989 |
| JP | 402131800 | 5/1990 |
| JP | 410096589 | 4/1998 |

DRYER DRUM VANE AND VANE SET

CROSS REFERENCE TO RELATED APPLICATIONS

This application claims priority to U.S. Provisional Patent Application Ser. No. 61/077,038 filed Jun. 30, 2008.

Commonly owned co-pending U.S. patent application Ser. No. 11/949,432, filed Dec. 3, 2007, and U.S. patent application Ser. No. 11/960,364, filed Dec. 19, 2007, are directed to technically related subject matter. The contents of these applications are hereby incorporated by reference in their entirety.

TECHNICAL FIELD

This invention relates generally to laundry dryers, and more particularly to elements mounted within a rotatable drum of the dryer for enhancing the tumbling and mixing action of the laundry load within the dryer, to thereby improve drying effectiveness.

BACKGROUND

Automatic laundry dryers generally employ a horizontally oriented, front load rotatable dryer drum for tumbling laundry during a drying process in which air, typically heated air, is introduced into the drum. The tumbling allows for the laundry to be sufficiently exposed to the air flow and also reduces wrinkling. Conventional dryer drums contain baffles or vanes on the interior of the drum which aid in tumbling the laundry. During rotation of the dryer drum, the vanes contact the laundry and lift it to help ensure that the laundry is tumbled. Most dryer drums have vanes with linear configurations which are generally uniform in height along their length. Further, some dryer drums have also been proposed which include vanes with recesses or shaped configurations for different purposes. See, e.g., U.S. Pat. No. 7,194,824 to Wang which discloses a stepped structure to prevent the clothes from remaining attached to the surface of the lifter without being released from the lifter at the top of the rotating drum. Also, U.S. Patent Publication No. 2007/0199207 of Oh et al. discloses baffles which are "crenellated" and include notches and recesses in the upper portions. U.S. Pat. No. 7,257,905 to Guinibert et al. discloses vanes which are sculpted to assist with even distribution of the laundry load during operation.

Aforementioned commonly owned copending U.S. patent application Ser. No. 11/949,432 discloses a dryer drum vane with a unique configuration to enhance the tumbling and mixing action of the clothes during a drying cycle. The configuration of the vane includes complex surfaces having varying angles of inclination relative to the base of the vane. These complex surfaces allow the clothes to be moved axially during the tumbling which promotes mixing of the clothes. Further, the vane has grip elements along its surfaces and the grip elements vary according to the angle of inclination of the complex surface on which it is positioned (e.g. the grip elements may vary in height relative to the angle of inclination).

Aforementioned commonly owned copending U.S. patent application Ser. No. 11/960,364 discloses a flow enhancing air duct and grill for laundry dryer. One aspect of the application is directed to positioning the air duct inlet and overlying grill within the depthwise extending cylindrical surface area of the bulkhead which defines the access port, instead of the conventional vertically oriented positioning of such elements.

There is room for improving the mixing capabilities of dryer vanes in order to more effectively dry clothes. For example, with known dryer vanes, laundry dryers may still be prone to harmonic tumbling of the load which leads to rolling and balling of the load. In addition, depending on the dryer configuration and the load characteristics, there may be a propensity for items of the laundry load (especially delicates) to become stuck on the exhaust air grill, thereby potentially reducing air flow and drying effectiveness. Therefore, it would be advantageous to provide a dryer vane that can more effectively mix the clothes of a laundry load and facilitate removal of items adhered to the exhaust air grill of the dryer, to thereby permit more effective drying of the clothes.

SUMMARY

One aspect of the invention is directed to a mixing dryer vane having a general profile which is scooped or "saddle" shaped. The mixing dryer vane has two relatively tall end portions and a reduced height central portion. The mixing dryer vane may have an upper surface that extends arcuately from one taller end portion to the other taller end portion. The arcuate shape may define along the length of the vane a relatively deep concavity which defines the reduced height central portion.

According to an aspect of the invention, the mixing dryer vane's taller end portions are configured and positioned to cause "wiping" of clothes off and away from an exhaust duct grill within the dryer. Specifically, the mixing dryer vane is configured with a tall end portion positioned in close enough proximity to the air grill that the tall end portion can sweep clothes of the laundry load across or closely adjacent to the air grill. In this manner, even if the taller end portion of the mixing dryer vane does not directly contact clothing lodged on the air grill, the taller end portion will carry or direct the other laundry load items so that these other load items will impact and tend to dislodge any items stuck on the air grill.

In another aspect of the invention, the taller end portions of the vane have a generally propeller-like twist presenting surfaces that serve to direct clothes towards the center of the drum (and the scooped central portion of the vane). In particular, an inclination of the leading face at the taller end portions of the mixing dryer vane provides an axial slope along at least the end surfaces of the vane which will direct laundry in the axial direction of the drum toward the center. Hence, the clothes will tend to slide along the slope of the twist to the reduced height central portion of the mixing dryer vane. At this point, the clothes will tend to fall through the "hole" presented by the scoop of the vane and onto a subsequent vane for rotation. In this manner, the inclined taller end portions along with the scooped much shorter central portion enhance the vane's ability to mix of the clothes, which leads to more efficient drying of the load.

In a related aspect of this invention, the scooped mixing vane in combination with other non-scooped (e.g., two conventional paddle-style) dryer vanes can provide a dynamic action which reduces or eliminates the tendency of harmonic tumbling of a load to occur. The scooped mixing dryer vane may be positioned on the interior surface of the drum in equilateral relationship with two non-scooped vanes. Such a combination of the scooped mixing dryer vane with the non scooped vanes can reduce or essentially eliminate harmonic tumbling of the load which can lead to undesirable conditions of rolling or balling the load. This can be accomplished by virtue of the central scoop of the mixing vane allowing a pass-through, or reduced lift/throw, of laundry items upon being circulated to the reduced height central portion. This action breaks the harmonic tumbling that may otherwise occur in the conventional case of three non-scooped vanes.

These and additional features and advantages of the invention will be further understood and readily appreciated from the following detailed description when read in conjunction with the accompanying drawings, which are included by way of example, and not by way of limitation with regard to the invention.

DETAILED DESCRIPTION

Figure 1:
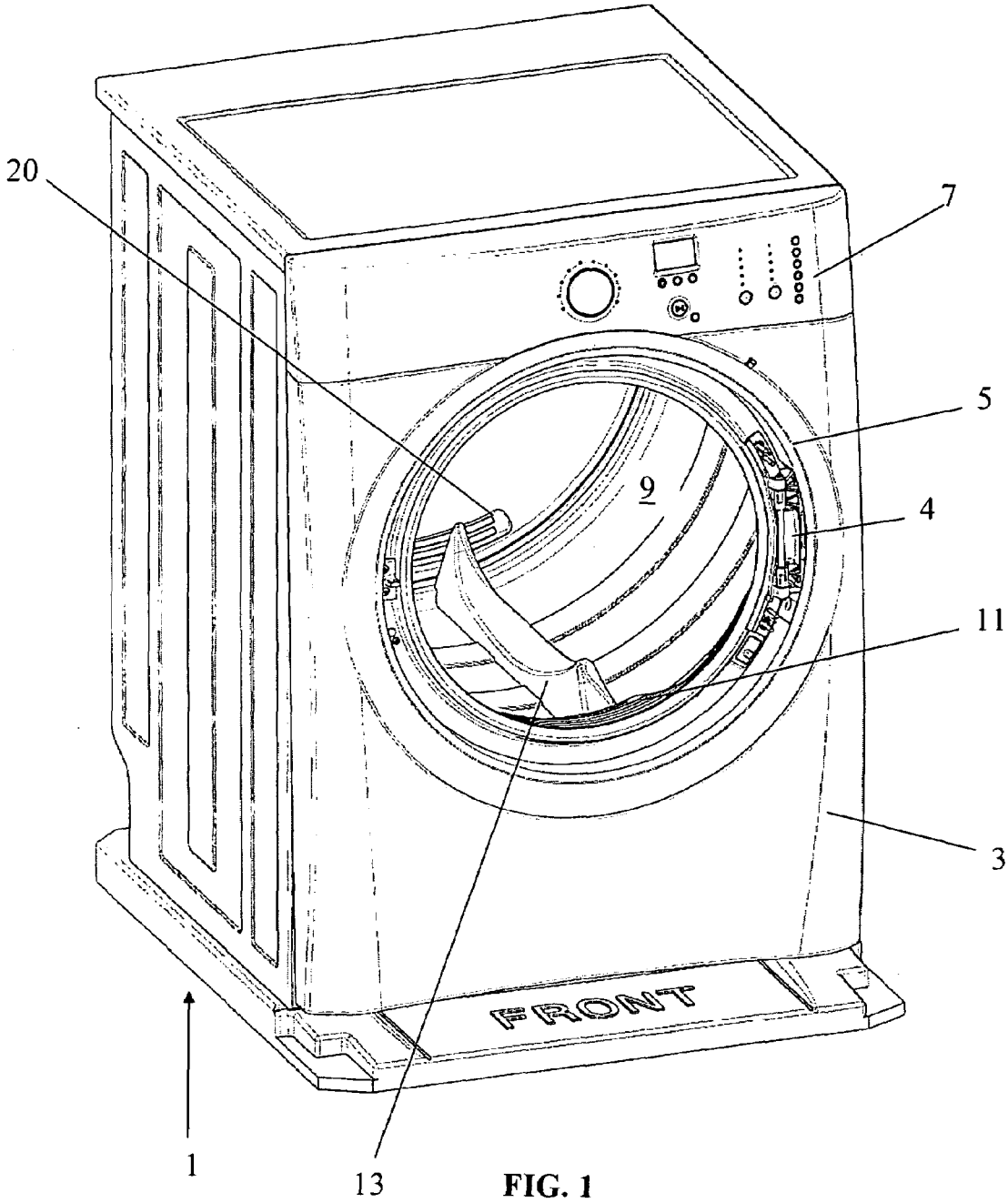
FIG. 1 is a perspective view of a dryer including a dryer vane set in accordance with aspects of the invention.

FIG. 1 shows an illustrative front-load automatic laundry dryer 1 incorporating aspects of the invention. The dryer 1 includes a generally rectangular housing or cabinet 3, and an access opening 5. As illustrated, the door that serves to cover the access opening is removed, and the dryer remains on a packing base (labeled "FRONT"). In the depicted embodiment, access opening 5 is circular and, in use, a door would be hinged to a front bulkhead or panel of the dryer at 4 to allow the user to open and close the door 5, to load and unload laundry into a drum 9 rotatably mounted within the housing 3.

Dryer 1 also includes a user interface (control panel) 7. The user interface 7 allows the user to control the operation of the dryer via such means as buttons, rotatable knobs, and lighted indicators, in a generally known fashion, such as selecting various drying cycles or drying cycle parameters such as drying time, temperature, etc. In addition, the user interface may include a display screen, such as a liquid crystal display (LCD), for indicating various cycle parameter settings. It will be understood that the dryer includes appropriate components for carrying out basic dryer operational tasks. Such components will typically include control electronics, a drive system for rotation of the drum, such as a motor-driven belt drive system, and a fan or blower for circulating air through the dryer.

Figure 4:
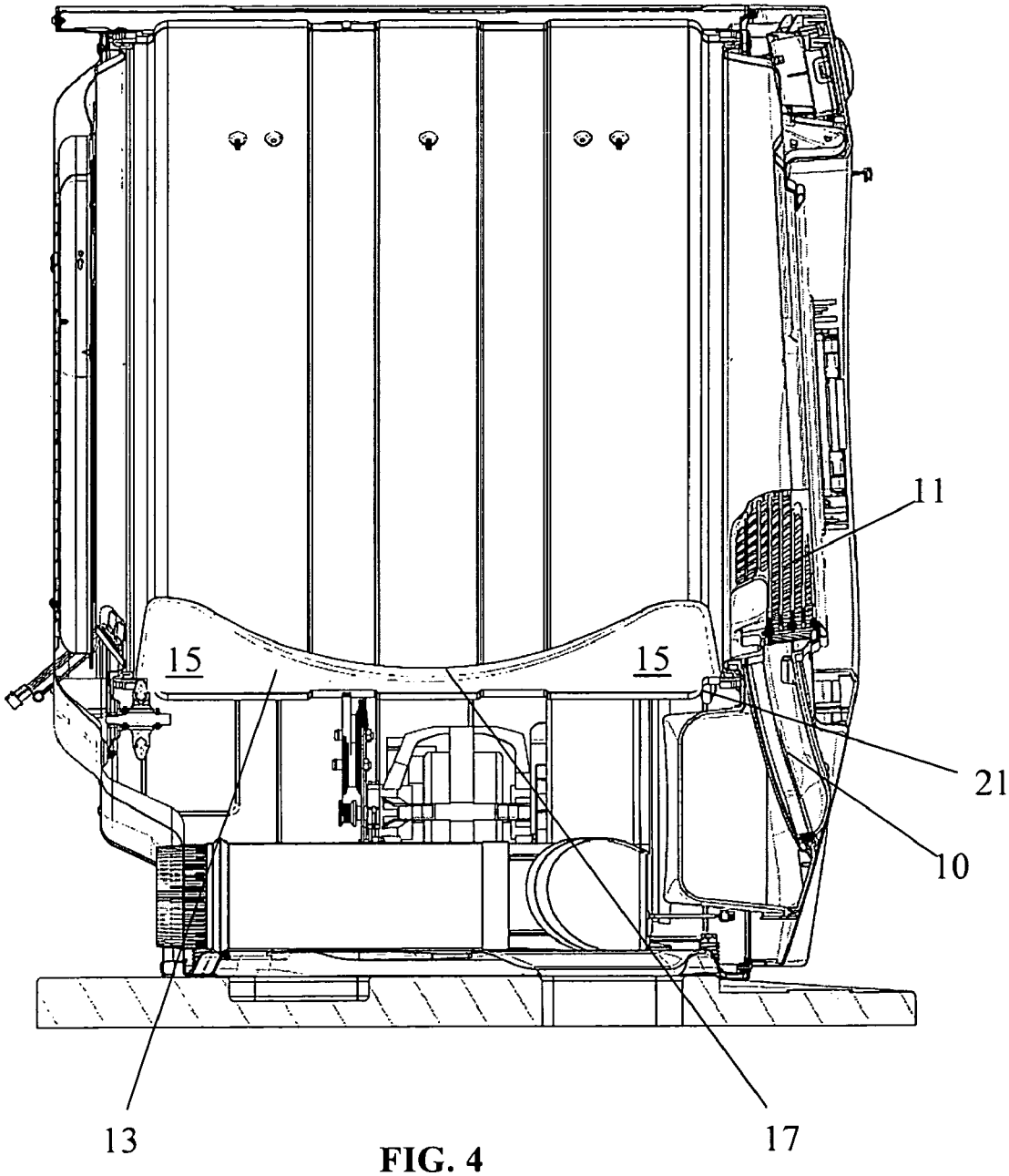
FIG. 4 is a rightwardly directed vertical sectional view of the dryer of FIG. 1, further showing the vane of FIG. 2 installed, and its positional relation to the exhaust air grill.
Figure 5:
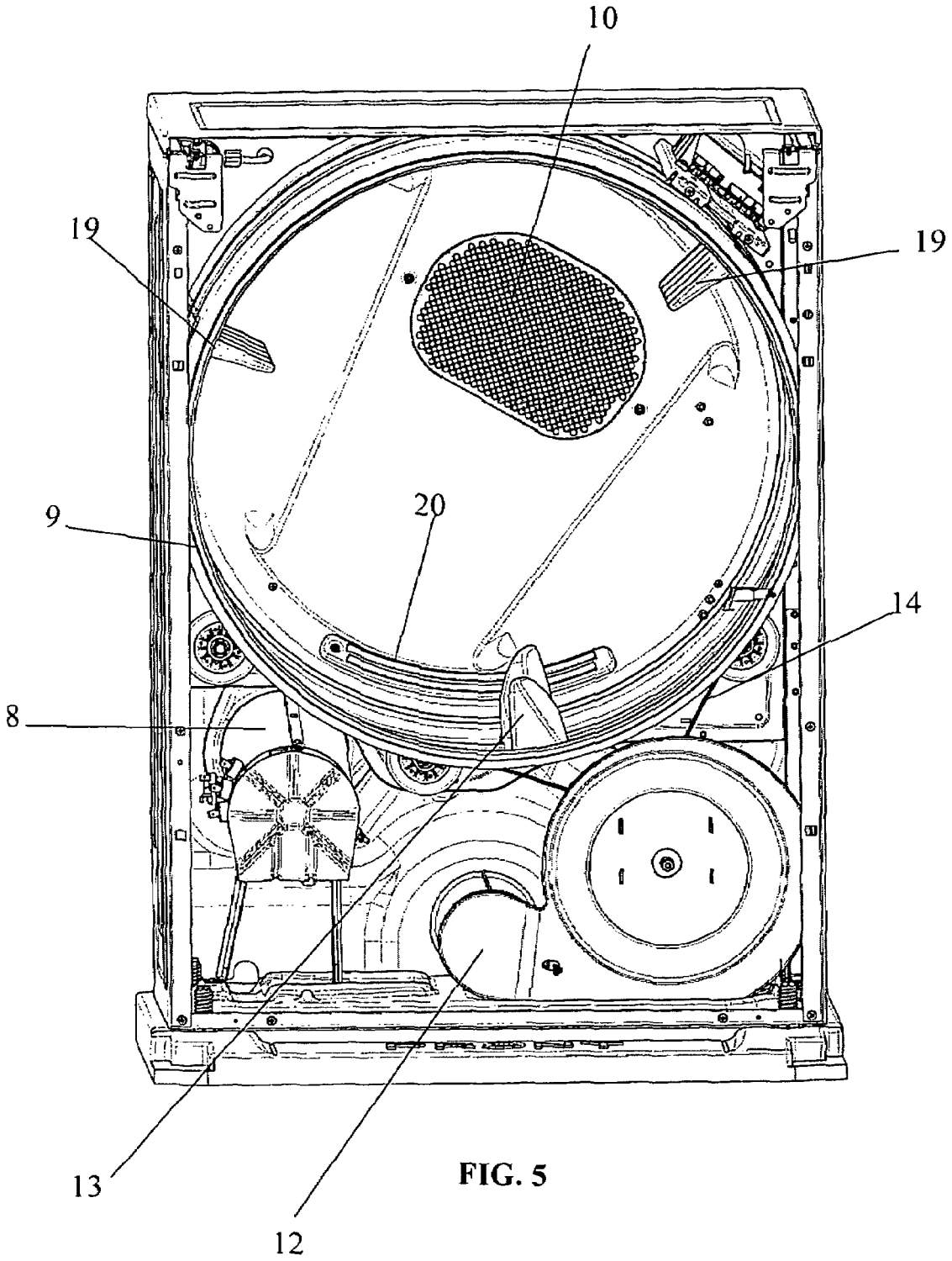
FIG. 5 is a front side perspective view of the illustrative dryer of FIG. 1 with the front panel removed in order to more clearly show aspects of the invention, including the scooped vane and its positional relationship with two non-scooped vanes.

With reference to FIG. 5, a canister-type heater 8 is positioned below rotatable drum 9 in which clothes are contained and tumbled during a dryer cycle. In a generally conventional manner, an air flow system draws air through heater 8 and into the drum 9 through a duct 10 provided on the backside of a rear bulkhead, to which a rear side of the drum 9 may be rotatably mounted. Preferably, air is drawn from inside of the housing into heater 8 to take advantage of heat exchange with the drum 9 and the heater. The air may be exhausted from the drum 9 through an outlet duct 10 and air grill 11 incorporated into the front drum-supporting bulkhead. See FIGS. 1, 3 and 4. The air grill 11 shown in FIG. 1 generally follows the arcuate shape of access port. In particular, the air grill 11 may have a semi-circular arcuate shape following the circular arc of the lower portion of the bulkhead surface defining the access port. The air duct 10 and air grill 11 are positioned at a central, lower portion of the front bulkhead clothes access port, and the air grill 11 may extend well beyond the underlying inlet of the exhaust air duct, on both sides of the inlet. This construction, and its benefits, are further described in aforementioned copending commonly owned application Ser. No. 11/960,364. A single motor may be used to drive both the rotation of the drum (in forward and reverse directions), and a blower. The blower is provided in fluid communication with the drum 9 outlet duct, to create a vacuum causing air to flow through the system and be exhausted outside of the housing through a rearwardly extending exhaust tube 12 (FIG. 5). The drum 9 may be driven by a motor via a belt 14 (FIG. 5) and drive pulley.

Figure 3:
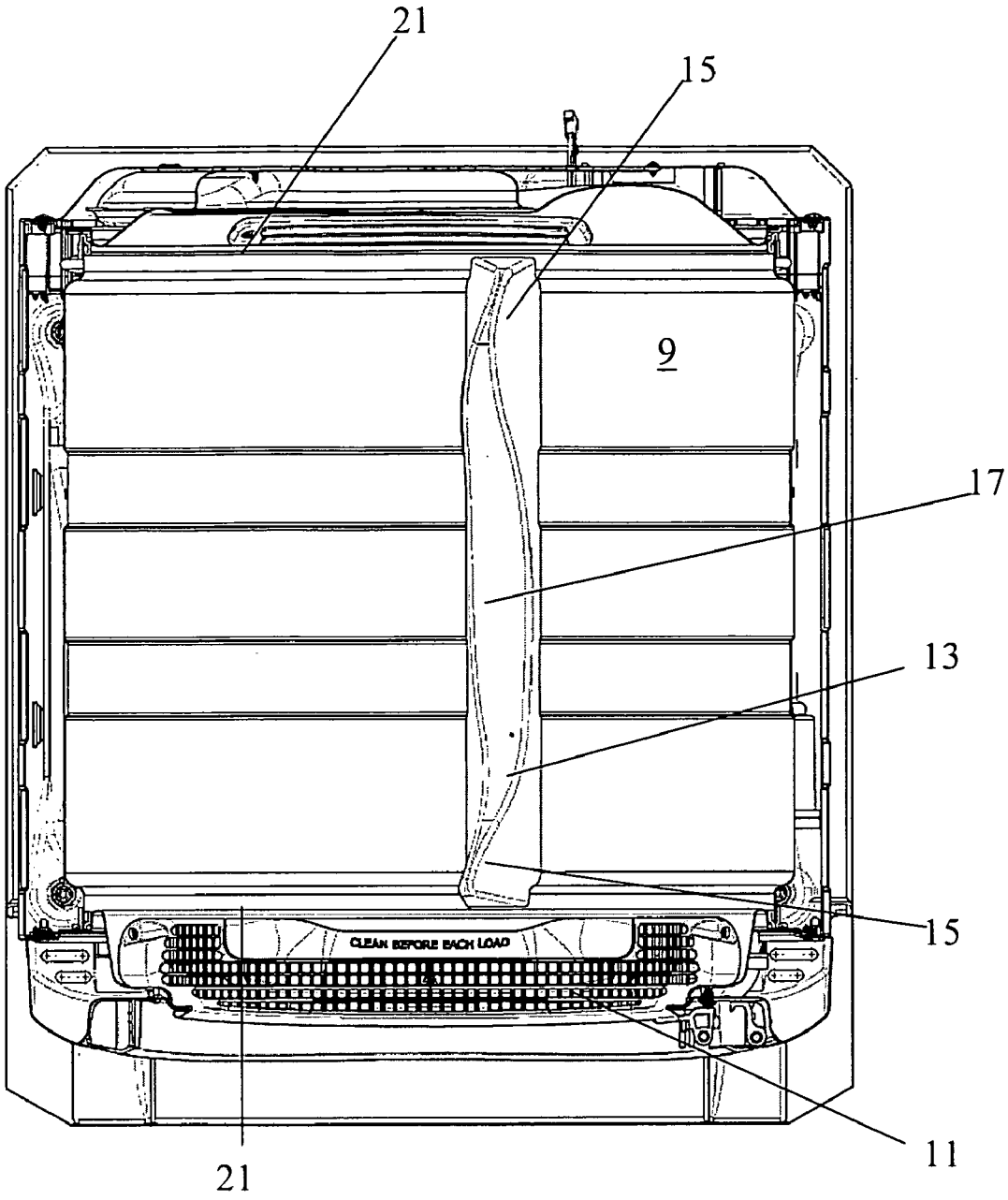
FIG. 3 is a downwardly directed horizontal sectional view of the dryer of FIG. 1, showing the vane of FIG. 2 installed, and its positional relation to an exhaust duct air grill of the dryer.

As shown in FIGS. 1, 3, 4 and 5, the dryer drum 9 contains plural dryer vanes which are positioned on the inner surface of the drum 9. Each vane may be integrally molded as a single piece, such as by injection molding in a correspondingly shaped mold form (die). In FIGS. 1, 3 and 4, a single exemplary scooped vane 13 in accordance with the invention is visible. FIG. 5 shows vane 13 in a set of three dryer vanes which are spaced approximately equilaterally (120 degrees apart) around the inner circumference of the dryer drum 9.

Figure 2:
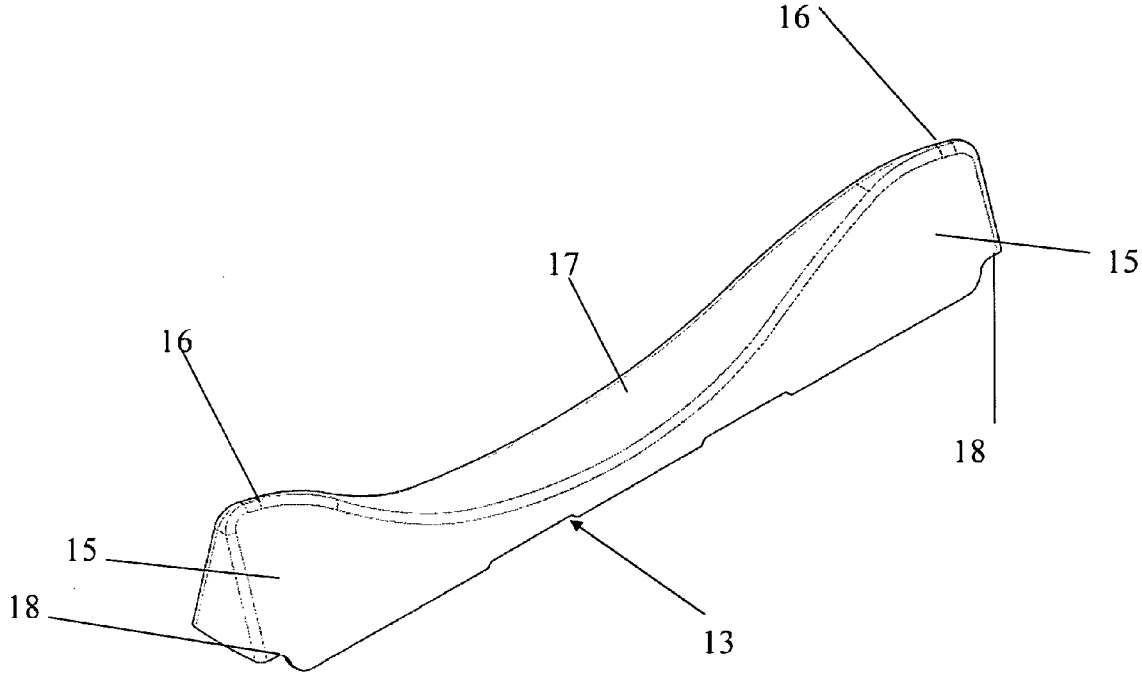
FIG. 2 is a perspective view of a scooped dryer vane according to particular aspects of the invention.

Illustrative scooped mixing dryer vane 13 is shown by itself in FIG. 2. Vane 13 is an elongated, generally linear structure having the general profile of a saddle, i.e., a top surface forming a relatively extreme scoop or concavity along the length of the vane, extending from substantially one end to the other. Vane 13 includes two relatively tall end portions 15. As shown, these end portions are generally triangular in transverse cross-sectional shape and have opposed leading and trailing surfaces that converge at central apexes 16. The scooped configuration of dryer vane 13 provides a relatively wide central portion 17 of substantially reduced height as compared with the taller end portions 15. As seen in FIG. 2, the dryer vane 13 has an upper arcuate surface that extends from one taller end to the other. The arcuate shape, which is convex at its ends, transitions smoothly to a relatively deep and wide central concavity that effectively presents a "hole" in the vane through which centrally positioned laundry load items may pass (with less lift/throw) during tumbling.

The taller end portions 15 of the mixing dryer vane 13, which may be comparable in height to the substantially uniform height of the non-scooped vanes 19 shown in FIG. 5, allow clothes to be lifted as the drum 9 rotates and, therefore, the clothes positioned toward the ends of the drum 9 are given high loft. On the other hand, the deep curve, or "scoop", allows clothes in the central part of the drum to pass through or over the mixing dryer vane 13 more readily, with less (if any) carry and throw. The pass-through effect of the "hole" provided in the mixing dryer vane 13 is significant because it allows clothes to more easily drop to the next vane in the rotation. This has the benefits of providing superior mixing of the load, and breaking any harmonic tumbling and rolling of load items due to a fixed uniform interval of vane contact and throw, as may occur with a conventional arrangement of three non-scooped vanes. In addition, the relatively extreme scoop of the saddle shaped mixing dryer vane 13 provides additional volume for accommodation of laundry load items, thereby reducing the negative impact on drum volume that dryer vane can have, i.e., increasing dryer capacity and increasing drying effectiveness for a given load size.

In the illustrated embodiment, both of the taller end portions 15 of the mixing dryer vane 13 are inclined (angled) relative to a longitudinal axis of the dryer vane. In particular, the taller end portions 15 can be "twisted" out of line with the length of the vane 13. An example can be seen in FIGS. 1, 3 and 5, wherein the illustrative vane 13 has a gentle "twist" imparted to its generally triangular (cross-sectional shape) taller ends 15. In a general sense, it is as if the taller end portions 15 of the elongated mixing dryer vane 13 were distorted by gripping the vane at its taller end portions 15 and imparting a slight relative rotation to the surfaces above the rectangular base, or by holding the taller end portions of the vane 13 stationary and imparting a slight twist to the surfaces about a center point of the vane 13. Such a twist can impart a generally propeller-like shape to the ends of elongated vane 13. Therefore, rather than extending strictly linearly, as seen in FIG. 3, the top of the vane exhibits a generally S-shaped curvature.

Dryer vane 13 exhibits reverse symmetry about a centerline extending normal to its longitudinal axis. A front-to-back orientation neutrality of the illustrative vane simplifies assembly, since the mixing dryer vane 13 can be inserted into the drum in either direction. This will save time and expense during the assembly process. In other embodiments, the propeller-like shape, or another angled surface configuration, may be provided at only one end, e.g., the end adjacent the exhaust duct air grill.

The "twisted" shape of the ends of the mixing dryer vane 13 can, in addition to tumbling the laundry, serve to convey load items toward the center during drum rotation in a given direction—clockwise as seen in FIGS. 1 and 5). The propeller-like twist at taller end portions 15 of the mixing dryer vane 13 provides an axial slope along the surface of the vane which will generally direct laundry in the axial direction of the drum 9 during tumbling. Hence, with clockwise drum rotation from the perspective of FIGS. 1 and 5, the clothes will tend to slide along the slope of the twist toward the reduced height (scooped) central portion 17 of the mixing dryer vane 13, where the clothes will tend to pass through the vane and fall onto the subsequent vane for rotation. In this sense, the vane 13 serves to "stir" the clothes. It will be appreciated that other vane configurations may be provided to direct laundry load items axially, e.g., straight vanes mounted at a skewed angle relative to the drum rotation axis. The taller end portions 15, along with the scooped, reduced height central portion 17, enhances the vane's 13 ability to mix of the clothes, which can lead to more efficient drying of the load. Further, the taller end portion 15 which is adjacent the air grill 11 aids in wiping clothes off the air grill 11, as described in greater detail below. The taller end portion 15 can then serve to direct the wiped away clothes toward the center of the drum 9.

As shown in FIG. 3, the mixing dryer vane 13 extends over substantially the entire front-to-back depth of the drum 9, so that the taller end portions 15 are positioned adjacent to the front and rear edges of the drum 9. Such an extended vane length provides a beneficial functionality of wiping load items from the exhaust duct grill, and has particularly advantageous application in a dryer with an air grill 11 as shown herein, which is configured as described and shown in co-pending commonly-owned U.S. patent application Ser. No. 11/960,364. In such a configuration, the air exhaust duct and overlying grill is arranged within the depthwise extending cylindrical surface area of the bulkhead which defines the access port. So configured, it is possible to arrange the access port lower in relation to the rotatable drum, to thus improve user access to lower and rearward portions of the drum that might otherwise be difficult to access (especially as the relative size of the drum is increased). However, such positioning of the exhaust duct grill may make it more likely that as the clothes are tumbling during typical dryer cycle, one or more articles of clothing may land on the air grill and obstruct it. An article of clothing may remain on the air grill drawn by the suction generated by the blower, until another tumbling article of clothing dislodges it.

The air grill disclosed in co-pending U.S. patent application Ser. No. 11/960,364, which has the same construction as the air grill of the embodiments described herein, has features which facilitate continuous unobstructed air flow. For example, as best seen in FIGS. 1, 3 and 4, air grill 11 extends beyond the air duct and up the inclined arcuate sides of access port. This extension, in conjunction with the spacing of the primary apertured surface of the grill 11 from the underlying bulkhead surface, permits air flow even when a significant central portion of the air grill 11 is obstructed by an article of clothing lodged on the air grill 11. Air is permitted to flow around an item of clothing adhered to a portion of the grill 11, until the article of clothing is removed.

Nonetheless, it would be desirable to limit the amount of time load items are adhered in contact with the air grill 11. Since an item adhered to the grill remains stationary (it is not tumbled) the drying of that item may be reduced, and also, drying effectiveness may be reduced overall, since the lodged item will not circulate into contact with the moisture sensor (bars 20 as seen in FIG. 5). The inventors found that this problem can be particularly acute in the case of delicates in a small/light load. The mixing dryer vane 13 can provide such an advantage, i.e., facilitate dislodging of clothes that become lodged on the air grill 11. Specifically, the mixing dryer vane 13 is constructed with a length such that one of the taller end portions 15 is positioned in close proximity to the air grill 11, e.g., with a small spacing of ¾-1 inch. This is in contrast to the much greater spacing provided between the ends of the other two conventional paddle-style vanes 19, which may be 2-4 inches. For example, as seen in FIG. 3, the front taller end portion 15 of dryer vane 13 almost contacts the air grill 11. Further, the height of the mixing dryer vane's taller end portion 15 provides a sweep in close proximity to the air grill 11. See, e.g., FIG. 4. The mixing dryer vane 13 is configured and positioned so that the front taller end portion 15 is tall enough and in close enough proximity to the air grill 11 so as to frequently sweep other clothes of the laundry load across the air grill 11. While the front taller end portion 15 of the mixing dryer vane may not directly contact the clothing lodged on the air grill 11, the front taller end portion 15 will carry other laundry load items, such that the other load items will impact and tend to dislodge any clothes stuck on the air grill 11. By causing such "wiping away" of clothes, etc. that stick to the air grill, the mixing dryer vane 13 limits the amount of the time the lodged clothing obstructs the air grill 11 and, therefore, the mixing dryer vane 13 provides even better air flow through the drum 9. In addition, by promptly dislodging any stuck items, a more consistent, thorough, drying of all items can be obtained.

As mentioned above, when an article of clothing remains on the air grill 11, it is not being rotated by the dryer drum 9 and, therefore, it is not being dried efficiently. By removing the article of clothing from the grill 11 and putting back in the rotation as quickly as possible, that particular article of clothing is dried much more efficiently. In small/light loads with delicates, the garments may be so light that they will be easily adhered to the grill by the suction of the blower. Especially in the case of a small light load, it may be unlikely that the garment will be quickly dislodged by the impact of another garment. The taller, closer front end portion 15 of the mixing dryer vane 13 will generally be more effective in causing other articles of clothing to impact articles adhered on the air grill 11 by sweeping them past the grill in close proximity, thereby clearing the grill.

In an aspect of the invention, the mixing dryer vane 13 is used with two "non-scooped" vanes. As shown in FIG. 5, the mixing dryer vane is positioned equilaterally around the drum 9 with two conventional paddle-style vanes 19. Such a combination of the scooped or "saddle"-shaped mixing dryer vane 13 with the two conventional non-scooped paddle vanes 19 can reduce or essentially eliminates harmonic tumbling of the load, as will now be described in further detail.

"Harmonic tumbling" refers to a condition wherein the load is impacted by the dryer vanes in a generally continuous (essentially non-varying) repeating pattern. Harmonic tumbling leads to undesirable conditions of rolling or balling of the load. In a case wherein there are three vanes in the drum, harmonic tumbling can result from the consistent pattern of three vane hits/throws per drum rotation (i.e. a 1-2-3 hits per rotation pattern). Utilizing a scooped mixing dryer vane 13 in conjunction with two conventional vanes can be effective to break this regular pattern. In particular, due to the deep scoop of the mixing dryer vane, generally only load items toward the ends of the mixing dryer vane will be carried high on the drum and thrown while the clothes in the center of the vane are not lifted as high, breaking the repetitive harmonic motion. Thus, as load items circulate to the center, the scooped portion of the mixing dryer vane will tend to pass under the items without substantial throw or carry (the items pass through the "hole" in the vane). Thus, a 1-2-3 (three vane hits/throws per rotation) pattern shifts to a 1-2-_ pattern (only two vane hits/throws per rotation). If the load items in the center are thrown, it will be to a much lesser degree, as generally the height of the vane establishes the angle the clothes are lifted up the side of the drum. In any event, the different dynamics break up the harmonic rolling and balling of the clothes that may otherwise tend to occur.

While the embodiment depicted in FIG. 5 has "non-scooped" vanes 19 in the form of straight, generally flat paddle-like vanes, other types of vanes could be used in conjunction with scooped mixing vane 13. For example, a twisted vane with grip elements, such as disclosed in co-pending application U.S. patent application Ser. No. 11/949,432 may be used as the "non-scooped" vanes.

The dimensions of the mixing dryer vane 13 can vary. The vane length may be essentially equal to the depth of the drum, e.g., as seen in FIGS. 3 and 4. In one embodiment, the height of the taller end portions 15 of the mixing dryer vane 13 may be between 3 and 4 inches, and the height of the non-scooped vanes is approximately the same.

The arcuate scoop or cut-out which defines the reduced height central portion 17 can vary in its length, depth and shape/slope. For example, at its lowest point, the reduced height of central portion 17 could be between ½ and one inch and have a slope of zero (horizontal). In some embodiments, at its shortest point, the reduced height of central portion 17 could be 50 percent, or less, of the height of the taller end portions 15, and a more extreme scoop providing a low point of 25% the height of the taller end portion 15, or less, will provide a greater pass-through action. In the illustrated embodiment, the low point of the shorter central portion 17 is approximately 20% of the height of the taller end portions 15 of the mixing dryer vane 13. A smooth continuous curve along the length of the vane is desirable to avoid edges which may snag, scrape or otherwise damage laundry load items. A continuous curve is not, however, strictly required. The cut-out could be provided in the form of a large, relatively deep rectangular or other shape cut-out.

The cut-out should be sufficiently wide and deep to encourage clothing and other load items to pass through a central portion of the vane during drum rotation—at least to some significant extent—as opposed to being consistently carried high on the drum and thrown as they would be by a non-scooped vane (or a vane with only small or subtle lower height portions). For example, the tall end portions 15 of the mixing vane 13, as well as the non-scooped vanes 19, may generally carry laundry load items relatively high to between the 9:00 and 11:00 positions of the drum 9 (assuming clockwise rotation, with 6:00 representing the bottom of the drum). On the other hand, the reduced height central portion 17 of mixing vane 13 will tend to only carry laundry load items to between the 7:00 and 9:00 positions of the drum 9, and perhaps more typically in the lower range of 7:00-8:00, depending upon the characteristics of the load and other factors, such as the drum rotation speed. In certain embodiments, the scooped or cut-out portion is reduced in height by at least 50% over a central portion representing at least 50% of the overall length of the vane.

The end portions 15 should be large (tall and wide) enough to effectively grip and carry (throw) laundry items at the front and rear of the drum high in the drum during tumbling, as noted above. The apexes of the taller end portions may be rounded to prevent damage to the clothes. The mixing dryer vane 13 may be secured to the drum 9 in a conventional fashion. Due to its extended length, which serves to place the ends of the vane adjacent the front and rear edges of the drum, however, notches 18 are provided in the bottom of the vane base at the outer edges of the taller end portions 15. These notches 18 accommodate raised (smaller diameter) shoulder portions 21 provided on the front and rear circumferential edges of the drum, as best seen in FIGS. 3 and 4.

In light of the foregoing disclosure and description of various arrangements, those skilled in the art will readily understand that various modifications and adaptations can be made without departing from the scope and spirit of the invention.

What is claimed is:

1. A dryer vane body comprising:

a base for mounting the dryer vane body within a rotatable dryer drum of a laundry dryer;

a first end portion at one longitudinal end of the dryer vane body;

a second end portion at an opposite, longitudinal end of the dryer vane body; and an upper surface forming a reduced height cut-out portion along an overall length of the vane, said upper surface extending from the first end portion to the second end portion, wherein:

the cut-out portion is reduced in height by at least 50%, relative to the height of the first end portion, over a central portion of the dryer vane body representing at least 50% of the overall length of the vane; and at its lowest point, the central portion is no more than 25% of the height of the first end portion.

2. The dryer vane body of claim 1, wherein, at its lowest point, the central portion is no more than 20% of the height of the first end portion.

3. The dryer vane body of claim 1, further comprising: a leading face surface for contacting and carrying laundry items as the dryer drum rotates, wherein, at the first end portion, the leading face surface is inclined relative to the longitudinal axis of the dryer vane body so that the leading face surface provides an axial slope along at least the first end portion which will direct laundry in an axial direction toward the central portion of the dryer vane body.

4. The dryer vane body of claim 3, wherein, at the second end portion, the leading face surface is inclined relative to the longitudinal axis of the dryer vane body in a direction opposite to the inclination of the first end portion.

5. The dryer vane body of claim 1, wherein the height of the first and second end portions is between 3 and 4 inches.

6. The dryer vane body of claim 1, wherein, at its lowest point, the height of central portion is between 0.5 and 1 inch.

7. The dryer vane body of claim 1, wherein the width of the upper surface of the dryer vane is greatest at the central portion and the width of the upper surface narrows as the upper surface extends towards the respective first and second end portions of the dryer vane body.

8. The dryer vane body of claim 1, wherein the first and second end portions are triangular in transverse cross-sectional shape.

9. A laundry dryer including a rotatable dryer drum, said drum having mounted on its inside surface, for rotation with said drum, a dryer vane body according to claim 1.

10. A dryer vane body comprising:

a base for mounting the dryer vane body within a rotatable dryer drum of a laundry dryer;

a first end portion at one longitudinal end of the dryer vane body;

a second end portion at an opposite, longitudinal end of the dryer vane body; and an upper surface forming a reduced height cut-out along an overall length of the vane, extending from substantially the first end portion to the second end portion, wherein:

the cut-out has a reduced height of at least 50%, relative to the height of the first end portion, over a central portion of the dryer vane body representing at least 50% of the overall length of the vane; and the upper surface of the dryer vane body extends arcuately continuously from the first end portion to the second end portion so as to define a central concavity.

11. The dryer vane body of claim 10, wherein the upper surface of the dryer vane body is convex at the first and second end portions.

12. The dryer vane body of claim 10, wherein, at its lowest point, the central portion is no more than 25% of the height of the first end portion.

13. A laundry dryer including a rotatable dryer drum, said drum having mounted on its inside surface, for rotation with said drum, a dryer vane body according to claim 10.

14. A dryer vane body comprising:

a base for mounting the dryer vane body within a rotatable dryer drum of a laundry dryer;

a first end portion at one longitudinal end of the dryer vane body;

a second end portion at an opposite, longitudinal end of the dryer vane body; and an upper surface forming a reduced height cut-out along an overall length of the vane, extending from substantially the first end portion to the second end portion, wherein:

the cut-out has a reduced height of at least 50%, relative to the height of the first end portion, over a central portion of the dryer vane body representing at least 50% of the overall length of the vane; and the dryer vane body exhibits a reverse symmetry about a center line of the dryer vane body normal to the longitudinal axis of the of the dryer vane body.

15. A laundry dryer including a rotatable dryer drum, said drum having mounted on its inside surface, for rotation with said drum, a dryer vane body according to claim 14.

* * * * *